US006733253B2

(12) United States Patent
Vockroth

(10) Patent No.: US 6,733,253 B2
(45) Date of Patent: May 11, 2004

(54) HYDRAULIC AIR COMPRESSOR HAVING AN AUTOMATIC WATER VALVE REGULATION MECHANISM

(76) Inventor: Richard W Vockroth, 243 Gray La., Painted Post, NY (US) 14870

( * ) Notice: Subject to any disclaimer, the term of this patent is extended or adjusted under 35 U.S.C. 154(b) by 0 days.

(21) Appl. No.: 10/187,835

(22) Filed: Jul. 3, 2002

(65) Prior Publication Data

US 2004/0005230 A1 Jan. 8, 2004

(51) Int. Cl.[7] ..... F04B 17/00; F04B 35/00
(52) U.S. Cl. ..... 417/401; 417/400; 91/270
(58) Field of Search ..... 417/385, 399, 417/383, 400, 401; 91/270, 342, 352, 303, 315

(56) References Cited

U.S. PATENT DOCUMENTS

| | | | | | |
|---|---|---|---|---|---|
| 417,653 | A | * | 12/1889 | Stanwood | 91/244 |
| 554,855 | A | * | 2/1896 | Ashworth. | 91/262 |
| 564,112 | A | * | 7/1896 | Sheff et al. | 91/270 |
| 607,837 | A | * | 7/1898 | Dorau | 91/264 |
| 609,953 | A | * | 8/1898 | Worthington | 91/154 |
| 627,572 | A | * | 6/1899 | Colwell | 91/160 |
| 641,981 | A | | 1/1900 | Mitchell | |
| 647,351 | A | | 4/1900 | Wood | |
| 651,550 | A | * | 6/1900 | Kron | 91/270 |
| 761,366 | A | | 5/1904 | Farnsworth | |
| 785,889 | A | | 3/1905 | Jones | |
| 807,448 | A | | 12/1905 | Farnsworth | |
| 1,328,160 | A | * | 1/1920 | Lawn | 60/39.6 |
| 1,385,027 | A | | 7/1921 | VanVleck et al. | |
| 1,488,171 | A | | 3/1924 | Savidge | |
| 1,524,989 | A | | 2/1925 | McMinn | |
| 1,811,579 | A | * | 6/1931 | Gerling | 91/270 |
| 1,857,719 | A | * | 5/1932 | Gerling | 91/264 |
| 2,316,356 | A | | 4/1943 | Nette et al. | |
| 2,559,842 | A | | 7/1951 | Bannister | |
| 2,863,600 | A | | 12/1958 | Pedroia et al. | |
| 3,589,839 | A | * | 6/1971 | Johnson | 417/391 |
| 4,240,329 | A | | 12/1980 | Inhofer et al. | 91/342 |
| 4,348,161 | A | | 9/1982 | Shibata | 417/403 |

* cited by examiner

*Primary Examiner*—Justine R. Yu
*Assistant Examiner*—William H. Rodriguez
(74) *Attorney, Agent, or Firm*—Carmine M. Cuda

(57) ABSTRACT

An improved air compressor powered by water having an automatic water valve regulation mechanism. The air compressor includes a resiliently biased piston within a liquid chamber and a ram within a compression chamber, the ram being conjoined with the piston. Inlet and outlet valves for controlling the flow of water with respect to the liquid chamber are provided in one end of the compressor. Ports for the inlet and outlet valves are preferably aligned parallel to the axis of piston reciprocation such that water flows through the ports in the same direction as the direction of piston movement. The automatic valve regulation mechanism includes a positioning disc and positioning spring, together holding each of the water valves in one of two positions. The regulation mechanism further includes a drive shaft connecting the water valves and the positioning disc to pivot in unison between the two positions, a drive disc pivotally mounted for depressing the positioning spring, and a coil spring connected between the drive shaft and the drive disc. The regulation mechanism also includes a trip rod having one end connected to the drive disc and having a pair of spaced apart stops along its length for contact with the piston at each end of the piston travel.

6 Claims, 2 Drawing Sheets

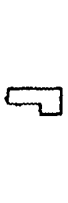
Fig 3
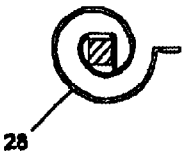
Fig 4
Fig 4a
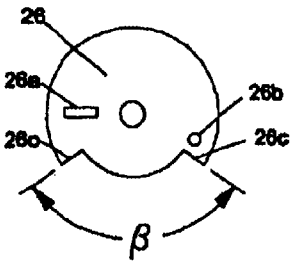
Fig 5
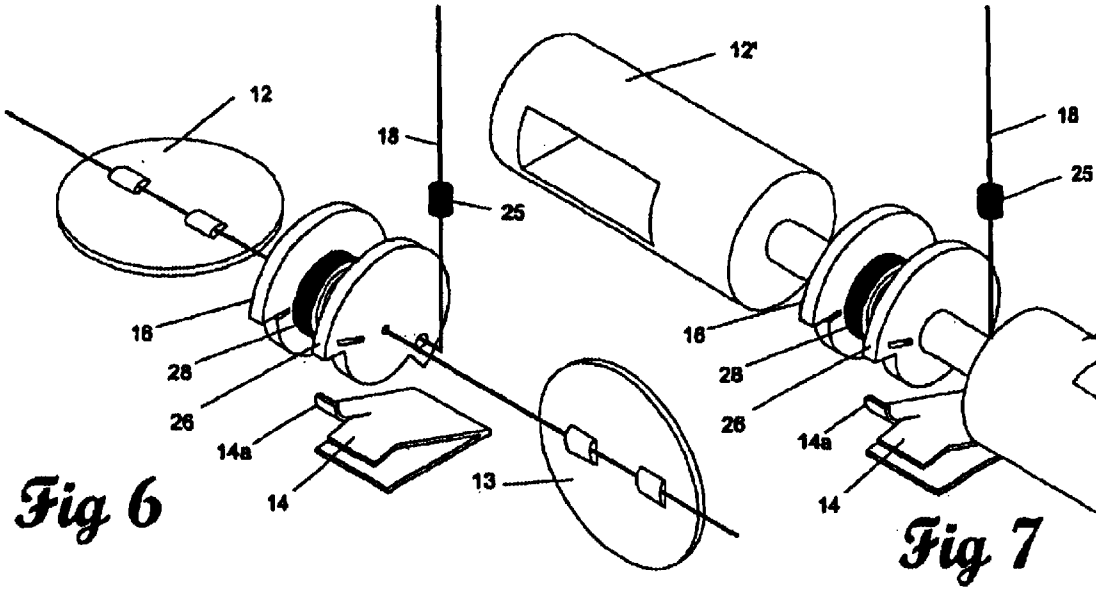
Fig 6
Fig 7

HYDRAULIC AIR COMPRESSOR HAVING AN AUTOMATIC WATER VALVE REGULATION MECHANISM

BACKGROUND OF THE INVENTION

This invention relates, in general to pumps or compressors, and in particular to an improved air compressor with automatic valve regulation powered by water.

DESCRIPTION OF THE PRIOR ART

In the prior art various types of devices are known for pumping or compressing fluids using water or other motive fluids. Conventional hydraulic air compressors that use gravity biased valves must be oriented, either horizontally or vertically, in order to function properly. Compressors using spring-biased valves are known but are generally complex and require many parts. Farnsworth, in U.S. Pat. No. 807,448, discloses a pump having a valve actuating weighted arm but this device must be used in an upright position. Jones, in U.S. Pat. No. 785,889, discloses a hydraulic air compressor but the main piston depends upon gravity to descend. Savidge, in U.S. Pat. No. 1,488,171, discloses a vacuum driven pump. Mitchell, in U.S. Pat. No. 641,981, discloses a hydraulic air compressor but this device must be oriented vertically. Farnsworth, in U.S. Pat. No. 761,366, discloses a fluid motive power pump but this device must also be vertically oriented. McMinn, in U.S. Pat. No. 1,524,989, discloses a hydraulic siphoning machine but requires a long cylinder for the reciprocating bar. Pedroia et al, in U.S. Pat. No. 2,863,600 discloses an air pressure control device but with an over-center spring biased valve. Inhofer, in U.S. Pat. No. 4,240,329, discloses a fluid pressure servo detent mechanism but flow through the opened valves appears to be impeded. Shibata, in U.S. Pat. No. 4,348,161, discloses a pressure converting apparatus with a directional control valve and a pilot valve. The known hydraulic air compressors are generally large and heavy and thus not easily transportable.

Other devices that use oscillating valves for regulation are known. Wood, in U.S. Pat. No. 647,351, discloses a valve designed to have a reciprocating rotary motion. Van Vleck et al,in U.S. Pat. No. 1,385,027, discloses an engine having a combined oscillatory and reciprocatory distribution valve. Nette et al, in U.S. Pat. No. 2,316,356, discloses a reversing mechanism with spiral springs, detents and cam members but in an oscillatory type fluid motor. Bannister, in U.S. Pat. No. 2,559,842, discloses a fluid-actuated motor having spring-and-latch valve-reversing means but requires approximately 180 degrees oscillation in each half cycle.

SUMMARY

In one form of the invention, a pump device is disclosed for compressing air using a pressurized source of water. The pump or air compressor includes a resiliently biased piston and ram and an automatic water valve regulation mechanism.

OBJECTS AND ADVANTAGES

Accordingly, several objects and advantages of this invention are to provide an air compressor which is lightweight and compact and easy to carry around.

It is an object of the present invention to provide an air compressor that may be used in any orientation.

It is an object of the present invention to provide an air compressor which is simple to make and easy to use.

It is an object of the present invention to provide an air compressor in which water ports may be aligned for efficient water flow.

It is a further object of the present invention to provide a pump or an air compressor with an automatic valve regulation mechanism which is reliable, simple and fast acting.

It is a further object of the present invention to provide an air compressor that is readily connectable to a conventional garden hose.

These and other objects, features and advantages of the present invention will become better understood with reference to the following description and claims, when taken in connection with the annexed drawings.

BRIEF DESCRIPTION OF THE DRAWINGS

FIG. 3 is a detailed view of the positioning disc.

FIG. 4 is a detailed view of the coil spring and drive shaft.

FIG. 4*a* is a detailed view of an end of the coil spring.

FIG. 5 is a detailed view of the drive disc.

FIG. 6 is a pictorial view of the majority of one embodiment of the valve actuation mechanism.

FIG. 7 is a pictorial view of the majority of a second embodiment of the valve actuation mechanism.

DETAILED DESCRIPTION OF THE INVENTION

Figure 1:
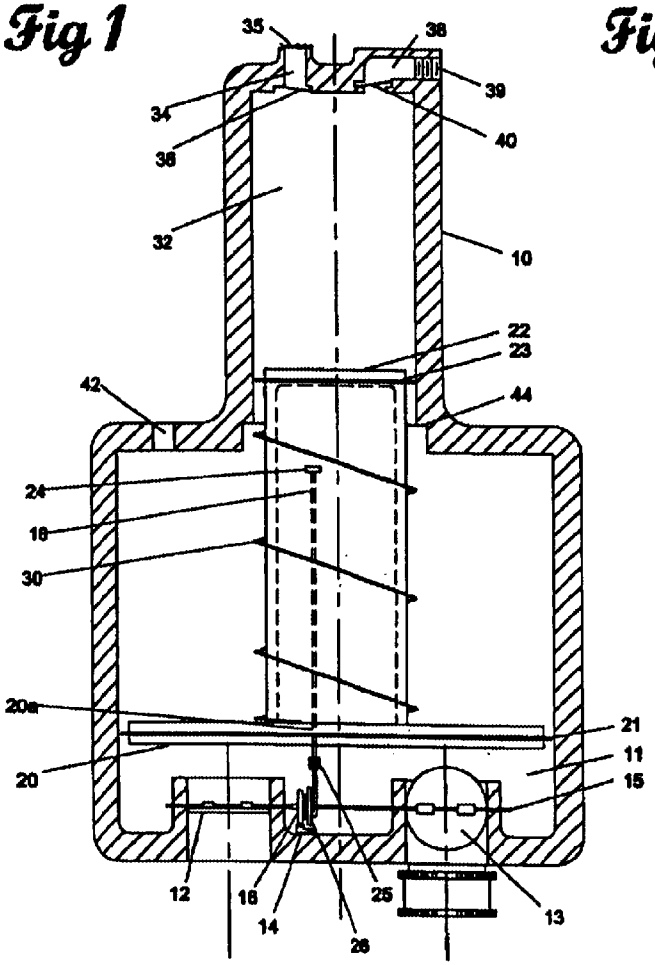
FIG. 1 is a side view of one embodiment of the present invention near the beginning of the cycle of operation.

FIG. 1 shows a preferred embodiment of the hydraulic air compressor 10. The body or housing of air compressor 10 includes a liquid chamber 11 near one end and a compression chamber 32 at the other end. Preferably, the housing is formed by molding from a suitable plastics material. The housing may be made of a plurality of parts which are bonded together by known methods such as thermal, chemical or adhesive bonding. Additionally, if disassembly of the housing were desirable, threaded parts or flanged and bolted or screw fastened parts are known and may be used instead. The liquid chamber 11 has an outlet port with a water outlet valve 12 and an inlet port with a water inlet valve 13. The water outlet valve 12 and water inlet valve 13 are fixedly connected to a drive shaft 15 for rotation about a common axis. The water inlet valve 13 is ninety degrees out of phase with respect to the water outlet valve 12 such that when the water inlet valve 13 is open, the water outlet valve 12 is closed and vice versa. Each of the water valves turns ninety degrees between fully open and fully closed positions thus providing nearly instant opening and shutoff.

A positioning disc 16 (best shown in FIG. 3) is connected to the drive shaft 15 to hold the drive shaft 15 in one of two positions that are ninety degrees apart. The positioning disc 16 includes a pair of slots 16*a*. A positioning spring 14 includes a lip 14*a* which is receivable within either of the slots of the positioning disc 16 to releasably hold the positioning disc 16 in either of the two positions. A drive disc or drive member 26 is rotatably connected to the drive shaft 15 via a central hole. A coil spring 28 (best shown in FIG. 4) has one end fastened to the drive shaft 15 and the second end connected to the drive disc 26. The drive disc 26 (best shown in FIG. 5) includes a receptacle 26*a* which receives the second end of the coil spring 28. The drive disc 26 also includes an offset hole 26*b* for receiving one end of a trip rod 18. Cusps 26*c* are defined on the periphery of the drive disc 26. The cusps 26*c* may be spaced apart by more than ninety degrees. The trip rod 18 includes a pair of spaced apart stops 24, 25 along its length.

The air compressor includes a piston 20 with a piston ring 21. The piston reciprocates within one end portion of the housing. The water inlet and outlet ports are preferably parallel to the axis of piston reciprocation. This is advantageous in that by aligning the ports, flow efficiency is optimized. The volume of the liquid chamber 11 is variable and is defined by the space within the one end portion of the housing between the piston and one end wall. The piston 20 also includes a hole 20*a* for slidably receiving a medial portion of the trip rod 18. The trip rod stops are positioned on the trip rod with one stop on each side of the piston.

A ram 22 extends from one side of the piston 20. An end of the ram 22 distal from the piston 20 includes a ram ring 23 and reciprocates within a compression chamber 32. Although shown as having a compression chamber with a smaller cross sectional area than the liquid chamber, alternative embodiments could have a compression chamber larger than or equal to the cross sectional area of the liquid chamber with minor modification. A return spring 30 extends about the ram 22 to return the piston 20 to its initial position when the water outlet valve 12 is open. One end of the return spring 30 abuts the piston and the other end abuts an internal shoulder or edge 44 in order to resiliently bias the piston. The return spring could be designed to exert a preloaded force on the piston such that the compressor is capable of operation in any orientation. The compression chamber 32 has an air inlet port 34 with an air inlet check valve 36 and an air outlet port 38 with an air outlet check valve 40. The check valves are preferably resiliently biased to be operable in any orientation also. The air inlet port 34 may include a filter 35. The air outlet port 38 may include a threaded portion 39 for connection to an air hose (not shown). For that matter, each of the ports may include a threaded portion or other known connectors to facilitate connection to a hose or tube. The space within the housing and between piston ring 21 and ram ring 23 is vented to atmosphere via at least one vent 42.

Figure 2:
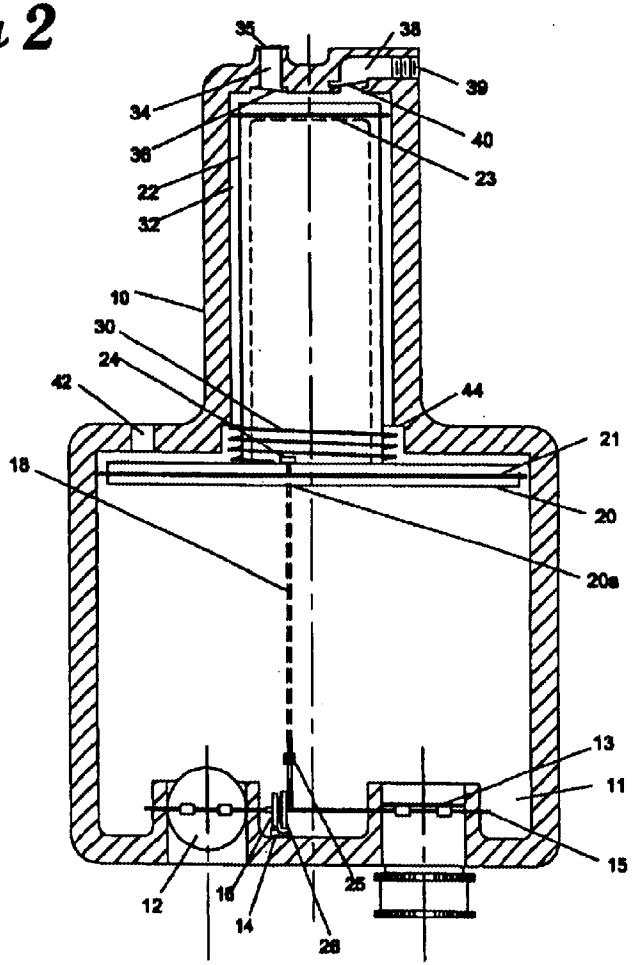
FIG. 2 is a side view of the first embodiment of the present invention later in the cycle of operation.

FIG. 2 shows a preferred embodiment of the air compressor 10 with the piston 20 displaced to an end of its travel. This is approximately half way through the cycle of operation of the compressor. The piston has compressed the return spring 30 between itself and an internal shoulder 44. The compressed air has been driven through the air outlet. The piston 20 has moved the trip rod 18 via stop 24. The trip rod has rotated the drive disc 26. The drive disc has biased the positioning disc via the coil spring and then released the positioning disc by co-action of the cusp and the positioning spring. The water inlet valve 13 is closed and the water outlet valve 12 is open. At this point in actual operation the liquid chamber 11 would be full of water (not shown). Continuing in the cycle of operation, the return spring 30 then pushes the piston back in the opposite direction and expels the water through the water outlet valve 12 as a fresh charge of air is drawn through the air inlet.

FIG. 3 shows a detailed view of the positioning disc 16 with a nonround central hole for receiving a mating portion of the drive shaft 15. The positioning disc 16 includes slots 16*a* spaced apart by an angle alpha which in the preferred embodiment is equal to approximately ninety degrees.

FIG. 4 shows a detailed view of the coil spring 28 attached at one end to the drive shaft 15 (shown in cross section).

FIG. 4*a* shows a detailed view of the second end of the coil spring 28.

FIG. 5 shows a detailed view of the drive disc 26. The drive disc 26 includes a central round hole for rotation on the drive shaft 15 and an offset hole 26*b* for receiving an end of the trip rod 18. The drive disc 26 includes a receptacle or opening 26*a* for receiving the second end of the coil spring 28 and cusps 26*c* spaced apart by an angle beta, which is preferably greater than ninety degrees.

FIG. 6 shows a pictorial view of most of one embodiment of the valve actuation mechanism with certain parts removed for clarity.

FIG. 7 shows a pictorial view of most of another embodiment of the valve actuation mechanism with certain parts removed for clarity.

The positioning spring 14 in FIGS. 6 and 7 is shown out of contact with the positioning disc 16 and drive disc 26 for clarity even though it is normally in contact with at least one of the discs. The drive disc 26 alternately biases the positioning disc in opposite rotational directions via the coil spring 28. As the drive disc is rotated clockwise due to the interaction of the return spring, piston, stop 25 and trip rod, the coil spring biases the positioning disc clockwise. The positioning disc is normally held in one of two positions by the positioning spring lip 14*a* being received in one of the two slots 16*a*. Upon continued clockwise drive disc rotation, one of the cusps 26*c* presses against the positioning spring and removes the lip 14*a* from the slot 16*a* This action causes the positioning disc to immediately rotate clockwise due to the clockwise coil spring bias. Clockwise rotation of the positioning disc opens the water inlet valve and closes the water outlet valve via the drive shaft 15.

As water fills the fluid chamber, the piston moves away from the stop 25 and towards the stop 24. The positioning spring lip 14*a* enters the second slot 16*a* and holds the positioning disc and water valves stationary. As the drive disc is rotated counterclockwise due to the interaction of the piston, stop 24 and trip rod, the coil spring biases the positioning disc counterclockwise. Upon continued counterclockwise drive disc rotation, the other one of the cusps 26*c* presses against the positioning spring and removes the lip 14*a* from the second slot 16*a*. This action causes the positioning disc to immediately rotate counterclockwise due to the counterclockwise coil spring bias. The water inlet valve closes and the water outlet valve opens as the positioning disc and interconnected drive shaft 15 rotate counterclockwise. The piston moves away from the stop 24 and towards the stop 25 due to the bias of the coil spring 28. The cycle of operation of the air compressor begins and ends with the water inlet valve in the open position and the piston abutting stop 25.

Other gaseous fluids may be compressed by suitable connection to the compressor. A slightly modified form of the invention may pump incompressible liquids. A pressurized supply source other than water may be used to drive the pump or compressor.

Although the hydraulic air compressor and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. In combination with a hydraulic air compressor having a resiliently biased piston and rotary inlet and outlet water valves, an automatic water valve regulation mechanism for controlling cyclic reciprocation of said piston, said regulation mechanism having means including a generally discoid shaped drive member and a positioning spring for alternately releasably holding and oscillatingly moving said rotary inlet and outlet water valves as a function of the position of the piston whereby said compressor is capable of multiple cycles of piston reciprocation.

2. The combination of claim 1, wherein said air compressor including a housing having a first end and a second end, said inlet and outlet water valves being located in water ports in said first end.

3. The combination of claim 2, wherein said water ports are aligned with respect to the piston movement such that as water flows into said inlet port, the water flows in the same direction as the direction of piston movement and such that as water flows out of said outlet port, the water flows in the same direction as the direction of piston movement, whereby the water flows efficiently since losses due to drag are minimized.

4. The combination of claim 1, wherein said air compressor including a resiliently biased air inlet check valve and a resiliently biased air outlet check valve and said piston being biased by a sufficient preload bias force such that said compressor is capable of operation in any orientation.

5. A hydraulic air compressor comprising, a liquid chamber with a piston reciprocatingly received therein, a compression chamber coaxial with the liquid chamber and having a ram received therein, the ram being conjoined with the piston, an inlet valve controlling flow of water into the liquid chamber, an outlet valve controlling flow of water out of the liquid chamber, a positioning disc holding each of said valves in one of two positions, a drive shaft connecting said valves and said positioning disc to pivot in unison between said two positions, a positioning spring releasably holding said positioning disc in one of said two positions, a drive disc pivotally mounted on said drive shaft and having a pair of cusp portions for depressing said positioning spring, a coil spring having one end nonrotatably mounted on said drive shaft and a second end connected to said drive disc, a trip rod having a pair of spaced apart stops along its length for contact with said piston at each end of the piston travel and having one end received within a hole of said drive disc, a return spring biasing the piston in a direction opposite to the direction of piston travel as water fills the liquid chamber, an air inlet valve allowing flow into said compression chamber through an inlet port, an air outlet valve allowing flow out of said compression chamber through an outlet port.

6. A pump device comprising, a first chamber near one end of said device, a second chamber near a second end of said device, a moveable element disposed between said first and second chambers such that as said element moves toward said one end, the volume of said first chamber decreases while the volume of said second chamber increases and as said element moves toward said second end, the volume of said first chamber increases while the volume of said second chamber decreases, an inlet valve and an outlet valve connected to said first chamber, said inlet valve controlling flow into said first chamber, said outlet valve controlling flow out of said first chamber, a positioning disk for holding each of said valves in one of two positions a drive shaft connecting said valves and said positioning disk to pivot in unison between said two positions, a positioning spring for releasably holding said positioning disk in one of said two positions, a drive disk having a pair of cusp portions for depressing said positioning spring, a coil spring having one end connected to said drive shaft and a second end connected to said drive disk, a trip rod having a pair of spaced apart stops along its length for contact with said moveable element at each end of said moveable elements travel and having one end connected to said drive disk, a biasing means for resiliently biasing said moveable element such that as said moveable element moves towards said second end said biasing means exerts a greater force on said moveable element, a second inlet valve connected to said second chamber and allowing only flow into said second chamber, a second outlet valve connected to said second chamber and allowing only flow out of said second chamber, whereby upon connecting said inlet valve of said first chamber to a source of supply fluid, a second fluid in communication with said second inlet valve is pumped or compressed by said device.

* * * * *